US006997267B2

(12) United States Patent
Kotovsky

(10) Patent No.: US 6,997,267 B2
(45) Date of Patent: Feb. 14, 2006

(54) METHOD AND APPARATUS FOR A LIGHTING AND/OR MECHANICAL SYSTEM

(76) Inventor: Irwin Kotovsky, 3941 California Ave., Pittsburgh, PA (US) 15212

( * ) Notice: Subject to any disclaimer, the term of this patent is extended or adjusted under 35 U.S.C. 154(b) by 393 days.

(21) Appl. No.: 10/090,515

(22) Filed: Mar. 1, 2002

(65) Prior Publication Data

US 2003/0164241 A1 Sep. 4, 2003

(51) Int. Cl.
*A62C 2/00* (2006.01)

(52) U.S. Cl. ..... 169/45; 169/16; 169/37; 169/41; 169/46; 239/208

(58) Field of Classification Search ..... 169/37, 169/16, 41, 43, 45, 46; 239/208, 209, 280.5, 239/281, 587.1, 588, 600; 52/39, 506.06, 52/506.07; 248/342, 343, 56, 75, 214
See application file for complete search history.

(56) References Cited

U.S. PATENT DOCUMENTS

| | | | | |
|---|---|---|---|---|
| 6,123,154 | A | 9/2000 | MacDonald et al. | 169/37 |
| 6,158,519 | A | 12/2000 | Kretschmer | 169/16 |
| 6,484,809 | B1 | 11/2002 | Elder | 169/37 |

*Primary Examiner*—Steven J. Ganey
(74) *Attorney, Agent, or Firm*—Ansel M. Schwartz

(57) ABSTRACT

A system for placement in a ceiling of a room to provide a fluid to the room. A method for protecting a room from fire. The method comprises the steps of placing a primary profile in a ceiling of the room. A system for placement in a ceiling of a room to provide air to the room. A method for providing air to a room. A system for placement in a ceiling of a room to provide sound to the room. A method for providing sound to a room. A system for placement in a ceiling of a room to provide information to the room. A method for providing information to a room.

8 Claims, 22 Drawing Sheets

METHOD AND APPARATUS FOR A LIGHTING AND/OR MECHANICAL SYSTEM

FIELD OF THE INVENTION

The present invention is related to a system for placement in a ceiling or wall of a room to provide a fluid, to provide air, to provide sound, or to provide information to the room. More specifically, the present invention is related to a system for placement in a ceiling or wall of a room with a sprinkler to provide a fluid, a duct opening to provide air, a speaker to provide sound, or a sign to provide information to the room.

BACKGROUND OF THE INVENTION

The present invention provides all specifiers—architects, designers, etc. and all users with a system for incorporating their lighting and other requirements in a flexible, inconspicuous, unobtrusive manner. Such a system does not exist. In the present invention, the sides of the profile are completely free of all openings and/or the intrusion of any hardware, although invisible hardware for whatever purpose, of course, can be utilized depending upon project requirements. The lamp source, wiring and other normal unattractive fixture hardware is not visible. In the past, when troughs were used hardware fastening devices, mechanical mechanisms and wiring were visible.

SUMMARY OF THE INVENTION

The present invention pertains to a system for holding equipment in a ceiling. The system comprises a first side member. The system comprises a second side member in spaced relation with the first side member. The first side and second side members define a length between them. The system comprises a connecting member which attaches to the first side and second side members and connects the first side member with the second side member. The length between the first side member and second side member is variable and defined by the length of the connecting member. The first side member and second side member and connecting member are distinct from each other.

The present invention pertains to a method for forming a lighting system comprising the steps of attaching a top plate to a first main profile and a second main profile in parallel and spaced relation with the first main profile to define a trough. Each main profile has a bottom. Then there is the step of connecting a trim or trimless profile in proximity to the bottom end of each main profile. Next there is the step of installing a lighting fixture in the trough.

The present invention pertains to a system for placement in a ceiling of a room to provide a fluid to the room. The system comprises a primary profile for placement in the ceiling. The system comprises a sprinkler extending into the primary profile and is adapted to connect to a pipe carrying the fluid so the sprinkler will spray fluid in the room when the sprinkler is activated.

The present invention pertains to a method for protecting a room from fire. The method comprises the steps of placing a primary profile in a ceiling of the room. There is the step of extending a sprinkler through the primary profile. There is the step of connecting the sprinkler to a pipe carrying fluid so the sprinkler will spray the fluid in the room when the sprinkler is activated.

The present invention pertains to a system for placement in a ceiling of a room to provide air to the room. The system comprises a primary profile for placement in the ceiling. The primary profile has a duct opening adapted to connect to a ventilation duct through which air flow from the ventilation duct enters the room through the primary profile.

The present invention pertains to a method for providing air to a room. The method comprises the steps of placing a primary profile in a ceiling of the room. There is the step of connecting a ventilation duct to a duct opening of the primary profile. There is the step of flowing air from the ventilation duct through the primary profile into the room.

The present invention pertains to a system for placement in a ceiling of a room to provide sound to the room. The system comprises a primary profile for placement in the ceiling. The system comprises a speaker attached to the primary profile.

The present invention pertains to a method for providing sound to a room. The method comprises the steps of placing a primary profile in a ceiling of the room. There is the step of attaching a speaker to the primary profile. There is the step of connecting wires between the speaker and a sound source.

The present invention pertains to a system for placement in a ceiling of a room to provide information to the room. The system comprises a primary profile for placement in the ceiling. The system comprises a sign having the information extending from the primary profile.

The present invention pertains to a method for providing information to a room. The method comprises the steps of placing a primary profile in a ceiling of the room. There is the step of attaching a sign to the primary profile.

BRIEF DESCRIPTION OF THE DRAWINGS

In the accompanying drawings, the preferred embodiment of the invention and preferred methods of practicing the invention are illustrated in which.

DETAILED DESCRIPTION

Figure 1:
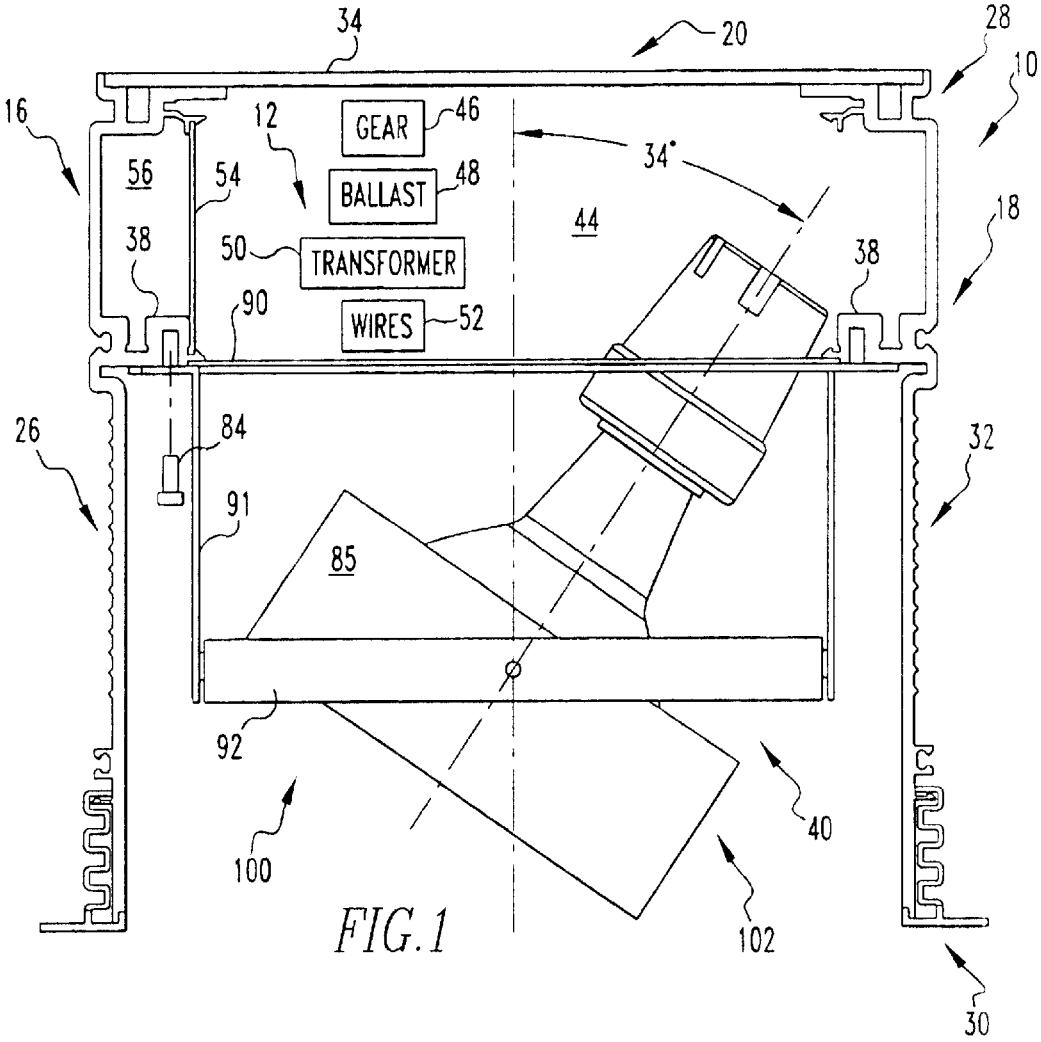
FIG. 1 is a schematic representation of a side view of a system of the present invention.
Figure 2:
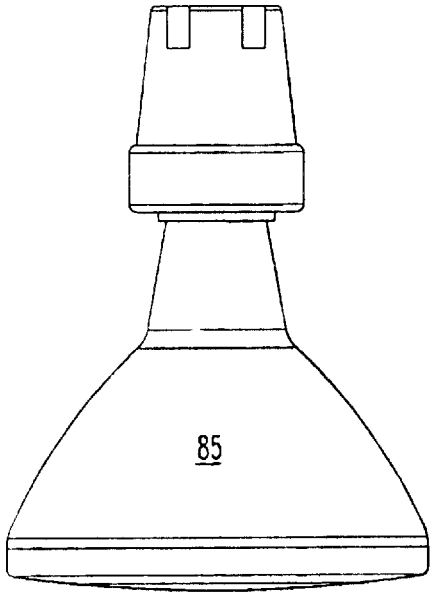
FIG. 2 is a schematic representation of a light.
Figure 3:
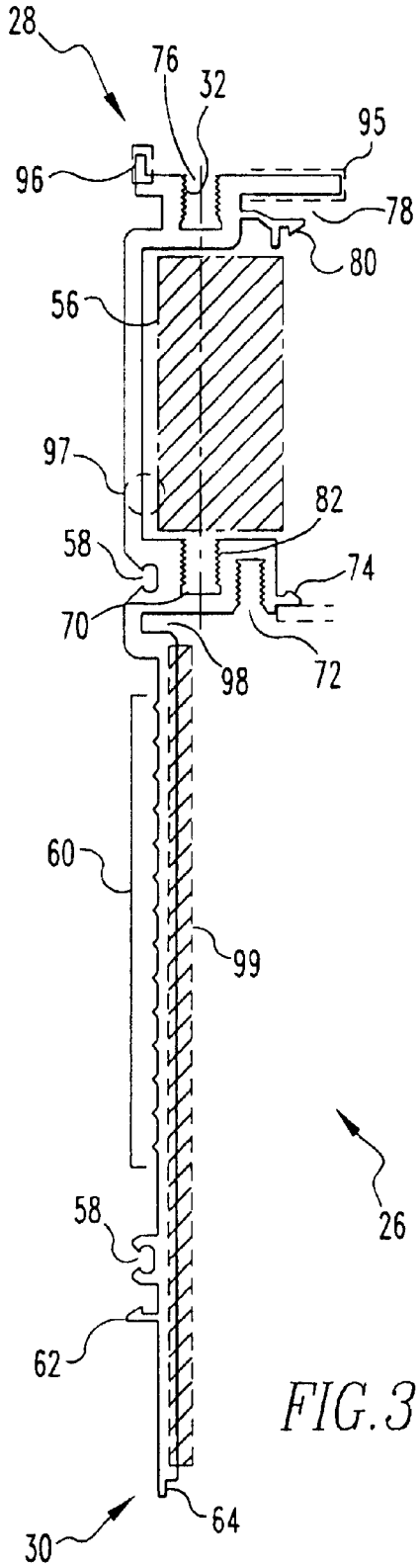
FIG. 3 is a schematic representation of a main profile.
Figure 4:
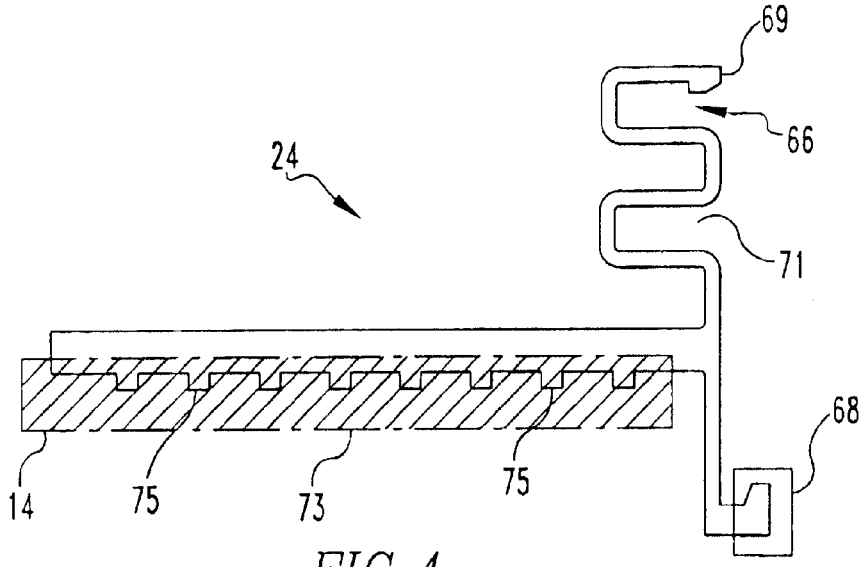
FIG. 4 is a schematic representation of a trimless profile which is attached to the main profile.
Figure 5:
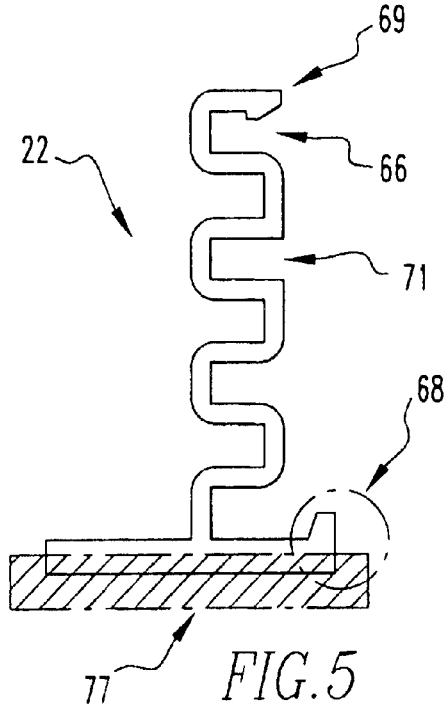
FIG. 5 is a schematic representation of a trim profile which is attached to the main profile.
Figure 6:
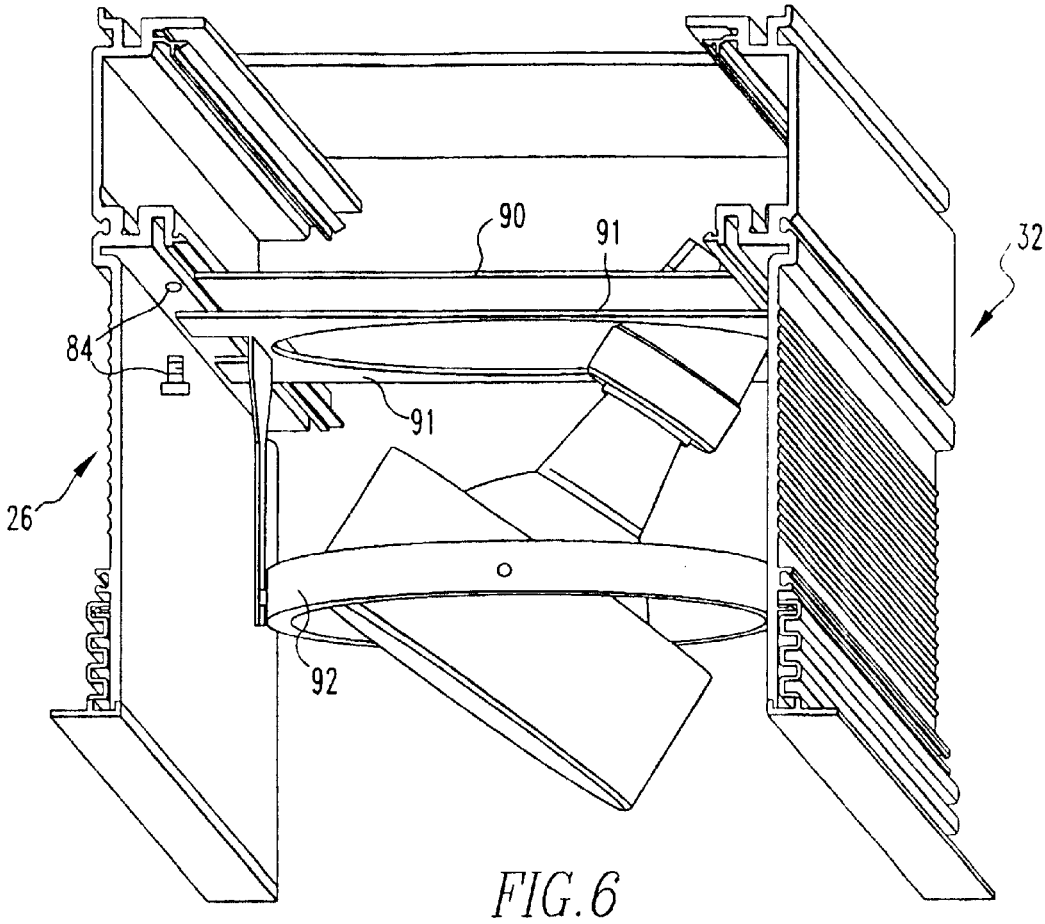
FIG. 6 is an isometric view of the system.
Figure 7:
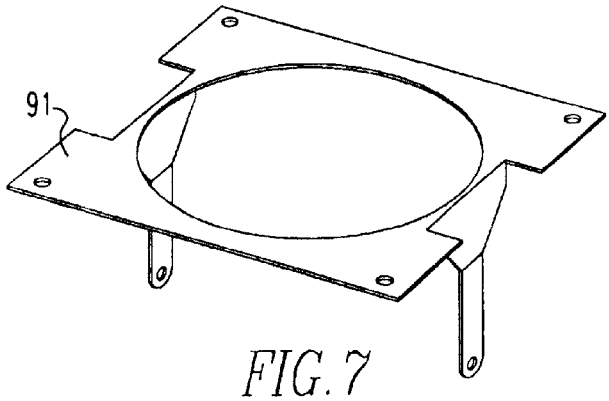
FIG. 7 is a schematic representation of a bracket.

Referring now to the drawings wherein like reference numerals refer to similar or identical parts throughout the several views, and more specifically to FIGS. 1–7 thereof, there is shown a system 10 for holding equipment 12 in a ceiling 14. The system 10 comprises a first side member 16. The system 10 comprises a second side member 18 in spaced relation with the first side member 16. The first side and second side members define a length between them. The system 10 comprises a connecting member 20 which attaches to the first side and second side members and connects the first side member 16 with the second side member 18. The length between the first side member 16 and second side member 18 is variable and defined by the length or width of the connecting member 20. The first side member 16 and second side member 18 and connecting member 20 are distinct from each other.

Preferably, the second side member 18 is in parallel with the first side member 16, and the connecting member 20 is perpendicular with the first and second side members. Preferably, the first side member 16 includes a first main profile 26 having a top 28 and a bottom 30 and the second side member 18 includes a second main profile 32 having a top 28 and a bottom 30. The connecting member 20 preferably includes a top plate 34 which attaches to the top 28 of the first and second main profiles.

Figure 10:
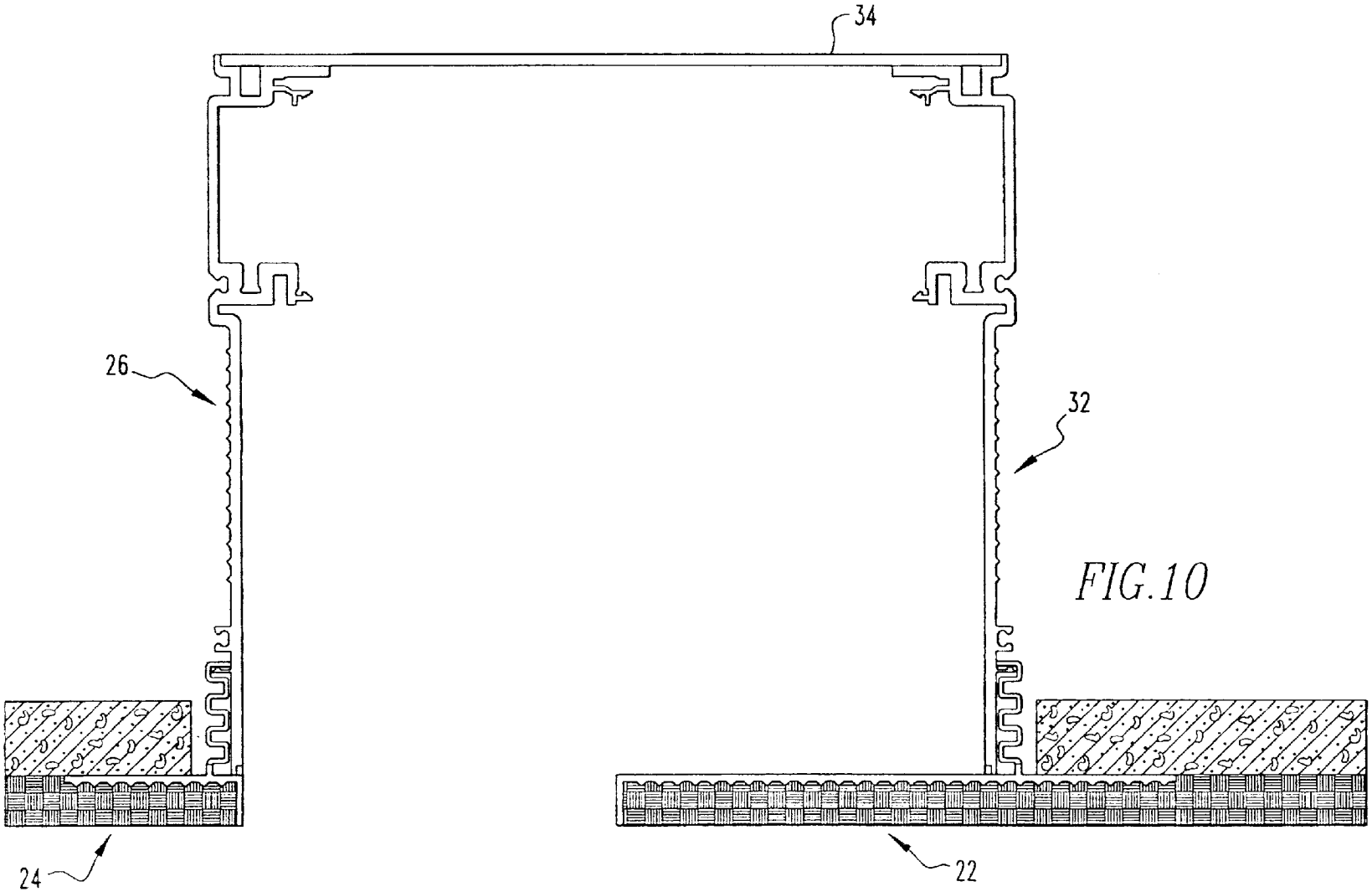
FIG. 10 is a schematic representation of an asymmetric trough.
Figure 11:
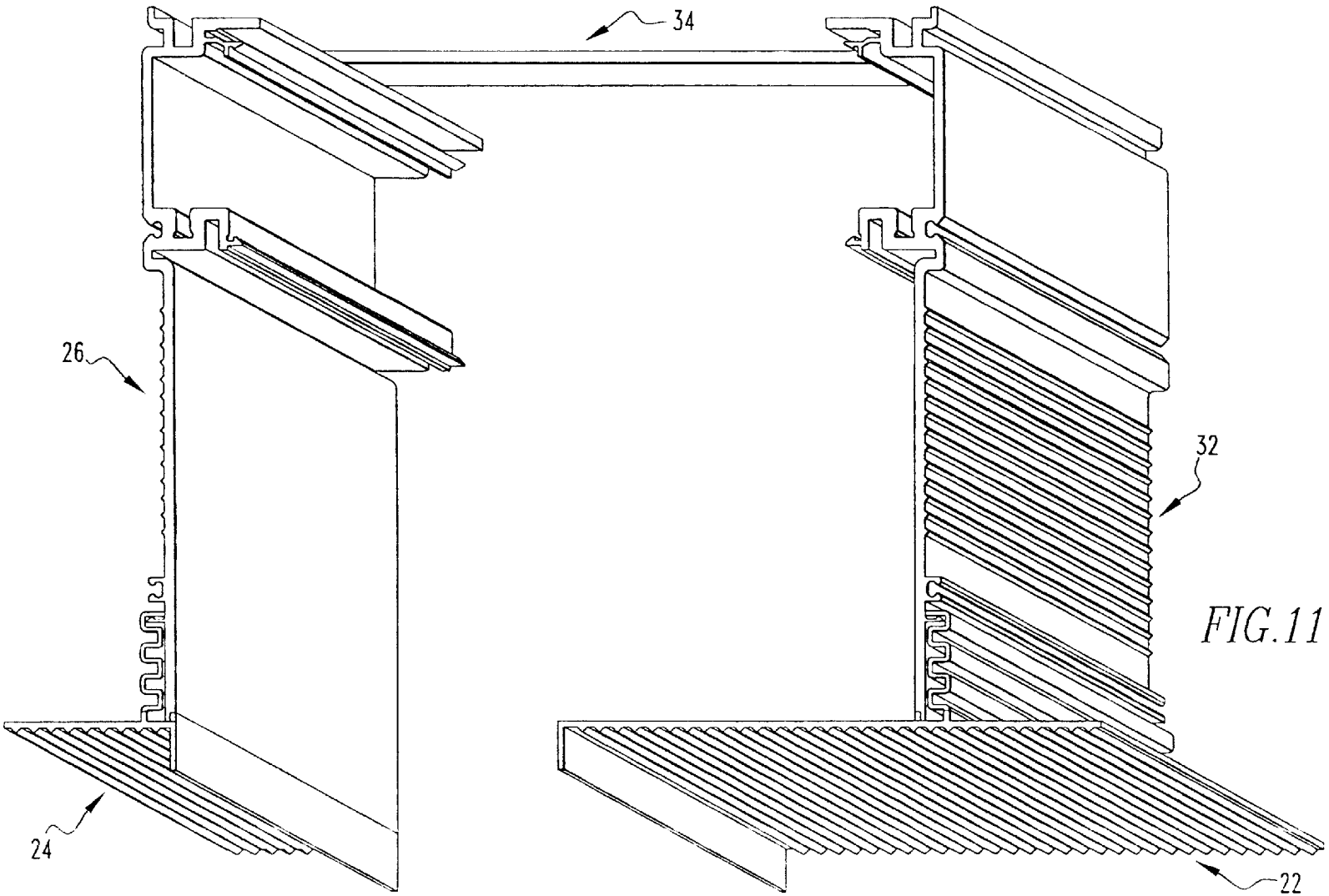
FIG. 11 is a schematic representation of an isometric view of the asymmetric trough.

The system 10 preferably includes a trim profile 22 and a trimless profile 24. Each side member attaches to either a trim profile 22 or a trimless profile 24 to form a symmetrical or asymmetrical cross-section, as shown in FIGS. 10 and 11. Preferably, the trim profile 22 or the trimless profile 24 is attached to the bottom 30 of the first or second main profiles.

Each main profile preferably includes an upper internally ribbed boss 36 in proximity to the top 28 of the main profile and a lower internally ribbed boss 38 in spaced relation with the upper internally ribbed boss 36. Preferably, the lower internally ribbed boss 38 is in parallel with the upper internally ribbed boss 36 and the top plate 34. The lower internally ribbed boss 38 on each main profile preferably are together adapted to hold a lamp 40 and define a horizontal cable run 44 between the top plate 34 and the lower internally ribbed boss 38 on the first and second main profile in which gear 46, ballast 48, transformers 50 or wires 52 can be disposed. Preferably, the lower and upper internally ribbed boss on each main profile together are adapted to hold a vertical plate 54 to define a vertical cable run 56.

Figure 9:
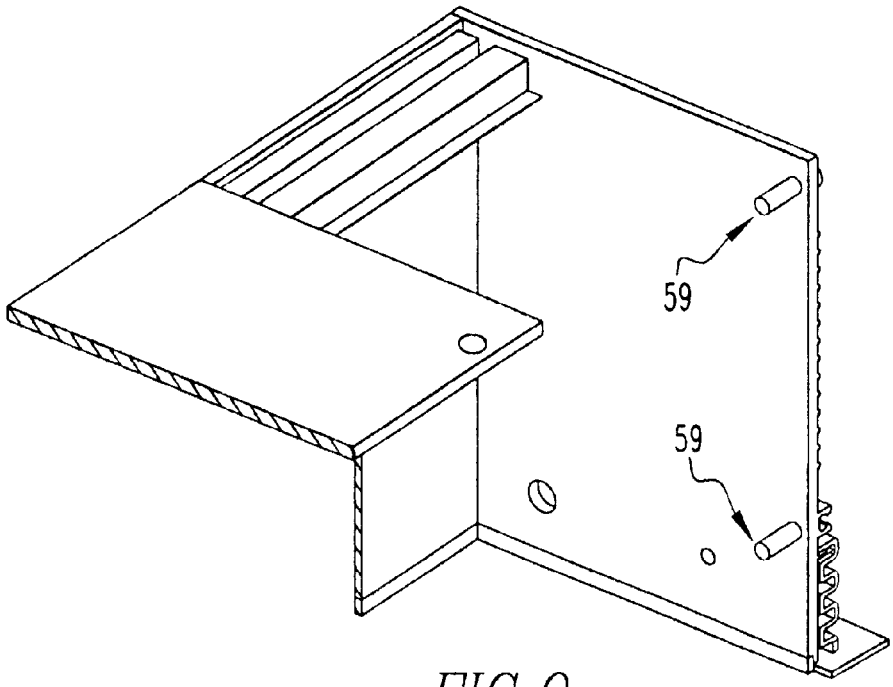
FIG. 9 is a schematic representation of a terminal plate with bolts.

Each main profile preferably includes external bosses 58 which are adapted to receive bolts 59 for supporting the first and second main profiles, as shown in FIG. 9. The external bosses 58 are preferably screw channels for ST 3.9 tapping screws; for fixation of terminating plates. Preferably, each main profile has horizontal ribs 60 to identify distance from the bottom 30 of each main profile. Preferably, the horizontal ribs 60 are part of the ceiling fixation; the ribs 60 can also serve as reference lines when holes must be drilled in this side of the main profile (for fixation of gimbal rings at different levels) The opposing inner surface 99 is able to remain clean and unmarked due to the overall design of the system. This provides for a more aesthetically pleasing trough. Each main profile preferably has a retaining rib 62 and a lower lip 64, and each trimless or trim profile has a slot 66 and a stem 68 which snap together with the retaining rib 62 and the lower lip 64, respectively, to hold the trimless or trim profile to the main profile. The retaining hub 62 is preferably a clipping feature that allows the profiles to be clipped irreversibly upon the main profile. The lower lip 64 preferably includes a space for the lower lip 64 of all trim or trimless profiles. The stem 68 preferably is an edge tab that hooks upon the main profile. The slot 66 preferably has a clipping feature 69 for irreversible clipping upon the main profile. There is preferably an M3 screw channel 71 for fixation of profile upon terminating plates. A zig-zagged morphology is used to increase the elastic play of the gripping feature. The trimless profiles can each have a platform 73 with dove-tail shaped ribs 75 for improved fastening of plasterwork attaching to the gypboard. The trim profile 22 can have a visible or trim surface 77 instead of the trimless platform 73.

Figure 8:
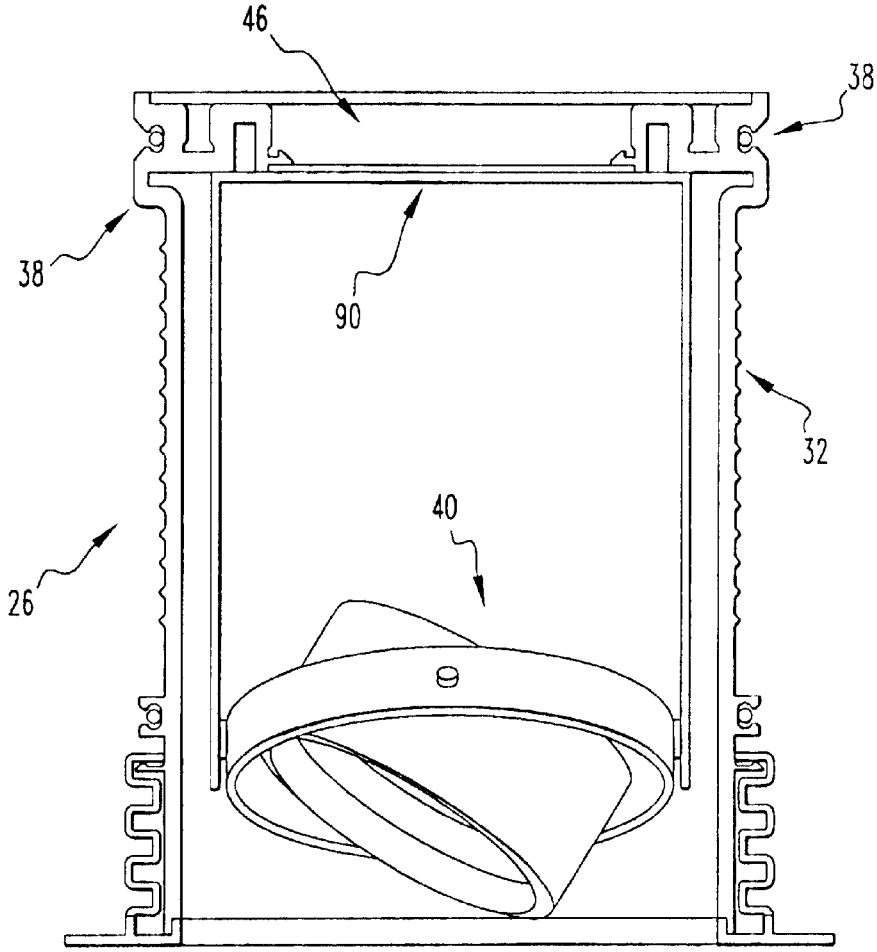
FIG. 8 is a schematic representation of a system having the main profiles reduced in size.

Preferably, each lower internally ribbed boss 38 has a first slot 70, a second slot 72 adjacent the first slot 70 and a lip 74 adjacent the second slot 72. Under the lip 74 there can be a space for inner cover plates 90 with thicknesses up to 1.2 mm. There can be a space 98 for platework parts with different functions: easy-slide-in lateral access by chamfered edge. The first slot 70 of the lower internally ribbed boss 38 is preferably used when the top half of the main profile is cut off, and is used for fixation of the "bridges" since it is grooved. See FIG. 8. Note also that the center lines of both the first slot 70 and the first slot 76 are collinear. The second slot is preferably an M6 screw channel for fixation of inner cover plates, brackets, yokes, a.s.o. with easy-entry chamfered edges. Each upper internally ribbed boss 36 preferably has a first slot 76, an upper inner horizontal slot 78 adjacent the first slot 76 and a lip 80 adjacent the upper inner horizontal slot 78. The upper inner horizontal slot 78 preferably is for mounting plates to be used for transformers, terminals or any component. The first slot 76 and first slot 70 are preferably M6 screw channels for fixation of the "bridges" that connect two main profiles to each other. Preferably, each slot has grooves 82 in which screws can thread. The lips of the lower and upper internally ribbed boss are preferably tabs with a clipping-feature for a vertical plate 54 that closes the wiring compartment. There is preferably a reference line 97 for a circular sawing-machine; the top half of the main profile can be cut off when the built-in height is limited and the lower internally ribbed bosses attach to the top plate 34. Also, there is preferably a tab 96 for easy and quick positioning of "bridges", and a second tab 95 that helps keep "bridges" perpendicular to the main profile. In addition, the first slot 76, the tap 96 and the second tap 95 can be used to increase the height of the trough, depending on the size of the equipment that fits in it.

Preferably, the system 10 includes an inner cover plate 90 that fits against the lip 74 of each lower internally ribbed boss, a lamp bracket 91 which is held against the inner cover plate 90 with screws 84 that penetrate the lamp bracket 91 into the second slot 72 of the lower internally ribbed boss 38, a yoke 92 which attaches to the lamp bracket 91 and a light 85 which attaches to a ring which attaches to the yoke 92.

The basis of this linear system 10 is the use of extruded aluminum members which can easily be connected to one another. This is accomplished by placing the trimless profile 24 at 90 degrees to the main profile, interlocking the edges of the profiles then rotating the trimless profile 90 degrees until it snaps and locks into position on the main profile. Once locked into position, it cannot be unsnapped. The connection between the trim profile 24 and main profile is accomplished in the same manner. The use of individual extruded aluminum members provides one with the ability and flexibility of creating whatever width and height of trough 100 that is desired.

The use of extrusions also allows for straight alignment, precise mitered butt joints and intersections. In addition, two trim details, trimless or overlapping trim are provided.

The system provides space for integral gear, ballasts, and also transformers. In addition two separate integral vertical race ways to the left and right of the main profile compartment space are available for wiring. It is therefore possible to separate low voltage wiring from line voltage wiring or to have low voltage wiring and line voltage wiring in one race way and wiring for other purposes in the other raceway.

Within the troughs, there are several methods of securing the various models of lamps. One of the most predominate methods of securing lamps is by the use of rings 102.

The lamp rings can be attached to the sides of the profile with screws that go through holes in the main profile and thread into holes in the rings.

The lamp rings can be attached to yokes which are mounted with screws to an interior cover plate attached at 98 or 72 that conceals the (gear, ballast, transformer, etc.). For remote gear applications the yoke is mounted to the top cover plate. The sides of the yoke have holes which receive screws that thread into the outer ring.

The rings can be attached to brackets 91 which fit into the slotted openings 98 on either side of the extruded aluminum profile. Either a single bracket 91 or pair of brackets 91 can be utilized. The brackets 91 can slide in the slots 98 and the rings can be positioned where desired.

The rings can be attached to a plate 90 which has a circular opening to permit long lamps to pass through. The plate 90 contains two arms or brackets for attaching the rings with screws. The plate 90 itself can be attached to slotted openings 98 that are on either side of extruded aluminum trough. The plate 90 can slide in these slots 98 for positioning where desired. The plate can also be attached to second slot 72.

The rings can be attached to a u-shaped interior trough with screws that go through holes in the sides of the u-shaped trough and thread into holes in the rings. This u-shaped trough is held in place in slots 98.

The outer ring can be attached to the side of the extruded aluminum profile, to the brackets and/or the yokes and can be adjustable and lockable in a similar manner to the adjusting and locking between the inner and outer rings.

The normal relationship of width of ceiling opening is such that at 45 degrees most of the beam of light is unobstructed.

Figure 14:
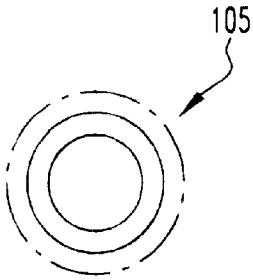
FIG. 14 is a schematic representation of an axial view of a spacer.
Figure 15:
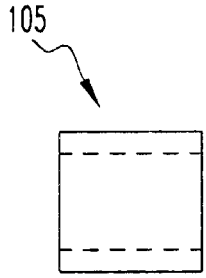
FIG. 15 is a schematic representation of a side view of a spacer.

As shown in FIGS. 14 and 15, a spacer 105 can be used between the outside ring and the main profile, bracket, or yoke to complete the fit between these parts.

Figure 12:
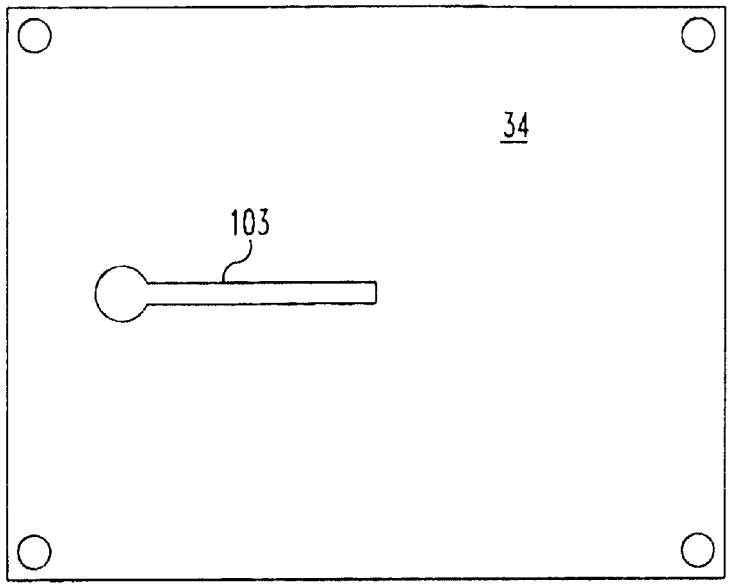
FIG. 12 is a schematic representation of an overhead view of a top plate.
Figure 13:
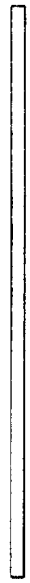
FIG. 13 is a schematic representation of a side view of a top plate.

Referring to FIGS. 12 and 13, the trough can be installed by rods on bolts in the ceiling. The number of rods used is determined by the length and weight of the trough. A threaded rod or bolt is attached to the main structural members (concrete, I-Beams, black iron, etc.). Attached to the bottom of the rod is a nut and washer. The nut and washers are small enough to pass through the circular opening of the key hole slot 103 and slide along the key hole slot 103 but large enough to retain the top plate and entire structure when in the slotted portion of the key hole. The rods can be placed on whatever centers are required to meet the on-site conditions.

The present invention pertains to a method for forming a lighting system 10 comprising the steps of attaching a top plate 34 to a first main profile 26 and a second main profile 32 in parallel and spaced relation with the first main profile 26 to define a trough 102. Each main profile has a bottom 30. Then there is the step of connecting a trim or trimless profile in proximity to the bottom 30 of each main profile. Next there is the step of installing a lamp 40 in the trough 102.

Figure 16:
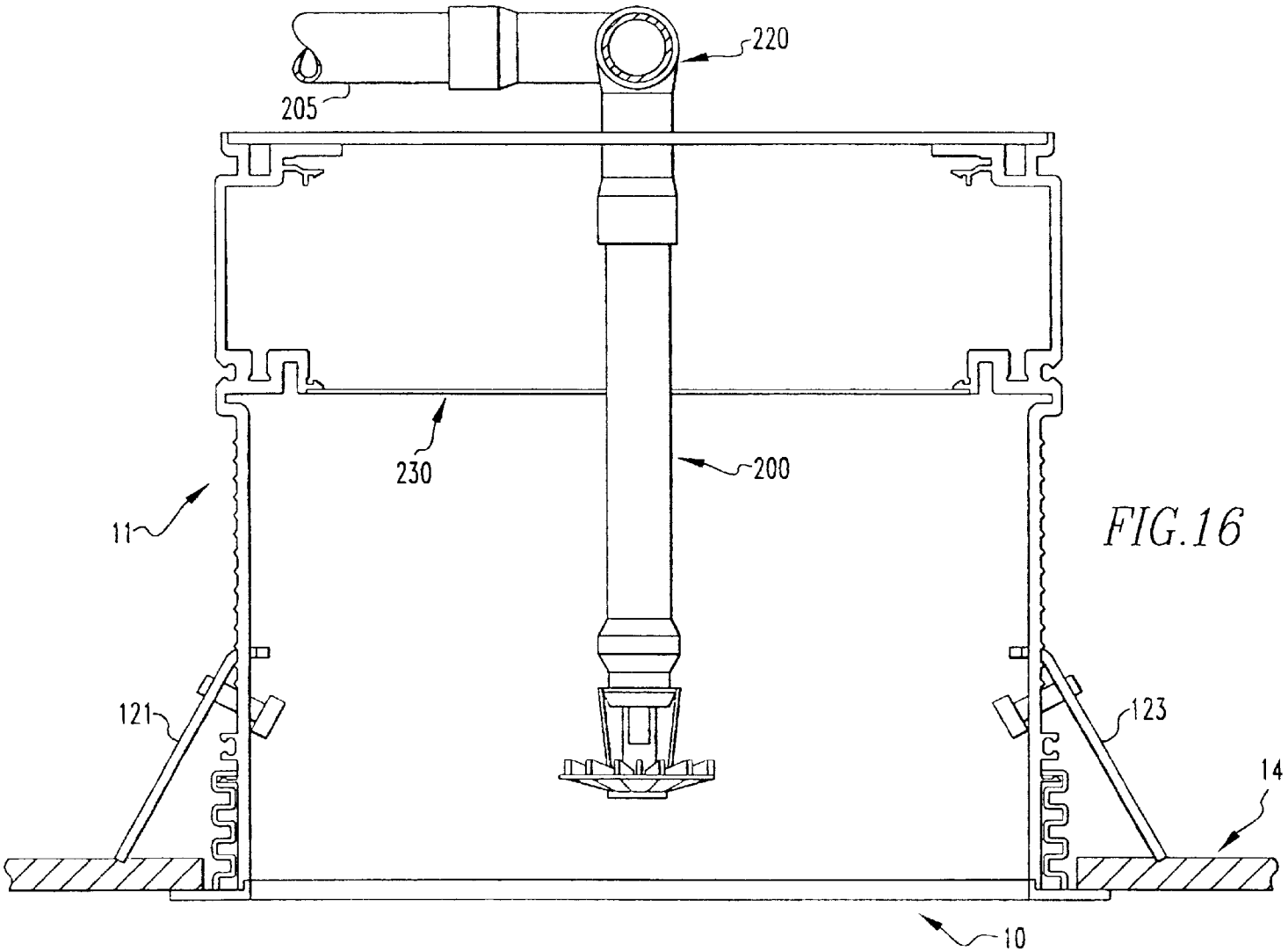
FIG. 16 is a cross-sectional view of a sprinkler and a primary profile.
Figure 17:
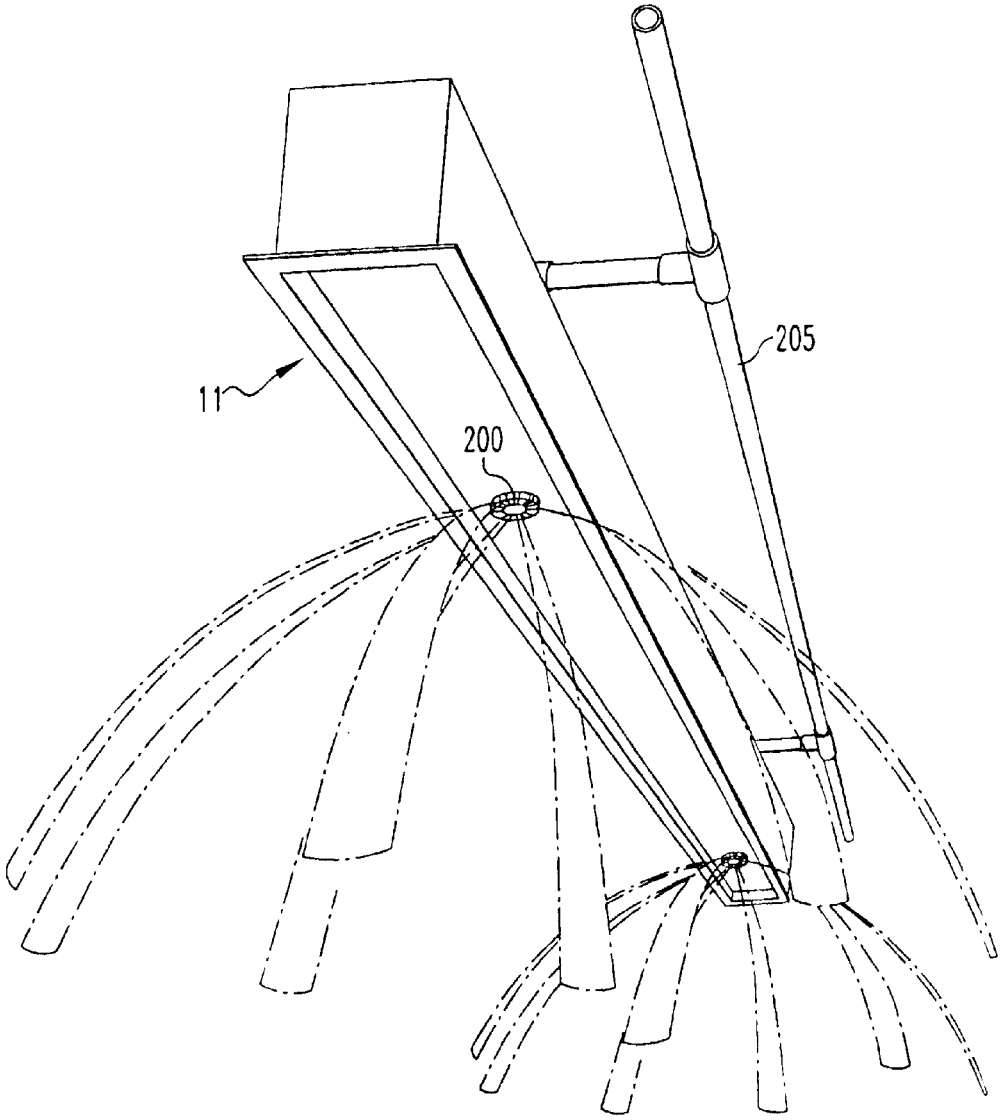
FIG. 17 is a perspective view of a primary profile with sprinklers.
Figure 18:
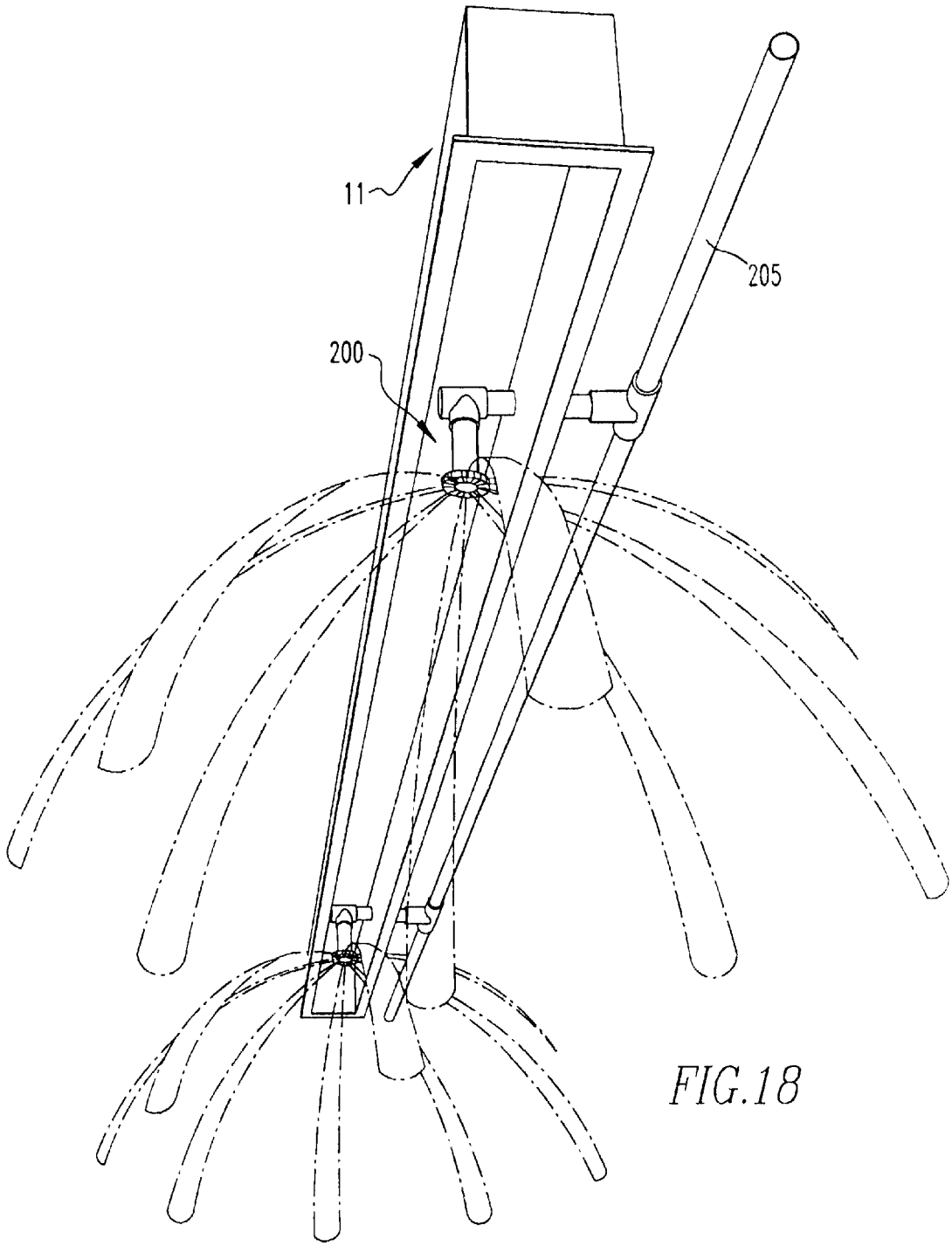
FIG. 18 is a perspective view of an asymmetric trim primary profile with sprinklers.
Figure 19:
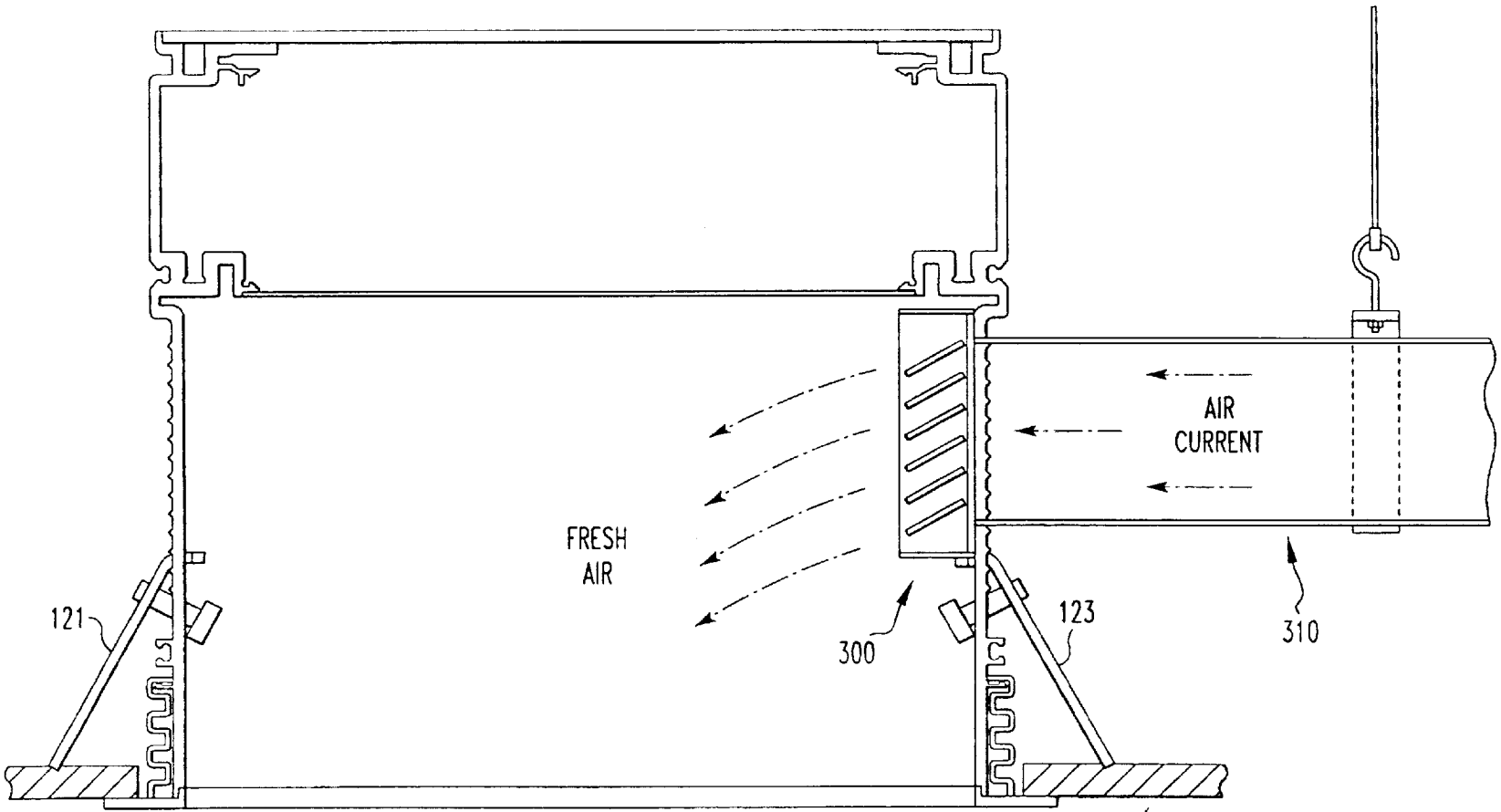
FIG. 19 is a cross-sectional view of a primary profile connected to a ventilation duct.

The present invention pertains to a system 10 for placement in a ceiling 14 of a room to provide a fluid to the room, as shown in FIGS. 16–18. The system 10 comprises a primary profile 11 for placement in the ceiling 14. The system 10 comprises a sprinkler 200 extending into the primary profile 11 and is adapted to connect to a pipe 205 carrying the fluid so the sprinkler 200 will spray fluid in the room when the sprinkler 200 is activated.

Preferably, the primary profile 11 includes a first side member 16 and a second side member 18 in spaced relation with the first side member 16. The first side and second side members define a length between them. The primary profile 11 preferably includes a connecting member 20 which attaches to the first side and second side members and connects the first side member 16 with the second side member 18. The sprinkler 200 extends into the primary profile 11 between the first side member 16 and the second side member 18 through the connecting member 20.

The sprinkler 200 preferably includes a juncture 220 which is adapted to connect with the water pipe 205 wherein water from the water pipe 205 can flow into the sprinkler 200. Preferably, the first side member 16 includes a first main profile 26 having a top 28 and a bottom 30 and the second side member 18 includes a second main profile 32 having a top 28 and a bottom 30, and the connecting member 20 includes a top plate 34 which attaches to the top 28 of the first and second main profiles. Each main profile preferably includes an upper internally ribbed boss 36 in proximity to the top 28 of each main profile and a lower internally ribbed boss 38 in spaced relation with the upper internally ribbed boss 36. The lower internally ribbed boss 38 on each main profile are together adapted to hold a middle plate 230 through which the sprinkler 200 extends.

Preferably, the system 10 includes a first clamp 121 and a second clamp 123 which holds the first side member 16 and second side member 18, respectively, in place in the ceiling 14. The first clamp 121 and the second clamp 123 are disposed against the ceiling 14 and the first side member 16 and the second side member 18, respectively. The lower and upper internally ribbed boss on each main profile together are preferably adapted to hold a vertical plate to define a wiring channel 430. Preferably, the system 10 includes a trim profile and a trimless profile, each side member attaching to either a trim profile 22 or a trimless profile 24 to form a symmetrical or asymmetrical cross-section.

The present invention pertains to a method for protecting a room from fire. The method comprises the steps of placing a primary profile 11 in a ceiling 14 of the room. There is the step of extending a sprinkler 200 through the primary profile 11. There is the step of connecting the sprinkler 200 to a pipe 205 carrying fluid so the sprinkler 205 will spray the fluid in the room when the sprinkler 200 is activated.

In operation, after the primary profile 11 is in place in the ceiling, the sprinkler 200 is inserted into it. The juncture 220 of the sprinkler 200 extends through the metal plate 230 and through the top plate 34 where it is attached to a water pipe 205. As is well known in the art, when fire or heat or smoke is detected by sensors of a sprinkler system, the sprinkler 200 is caused to be activated and spray water from water pipe 205. By being disposed in the primary profile 11, it is generally hidden from view, but by the sprinkler head being located just above the bottom of the primary profile 11, the sprinkler is activated, the spray is effectively dispersed into the room without being blocked by the first and second main profiles.

The present invention pertains to a system 10 for placement in a ceiling 14 of a room to provide air for heating or cooling the room, as shown in FIGS. 19–24. The system 10 comprises a primary profile 11 for placement in the ceiling 14. The primary profile 11 has a duct opening 300 adapted to connect to a ventilation duct 310 through which air flow from the ventilation duct 310 enters the room through the primary profile 11.

Preferably, the primary profile 11 includes a cover 320 through which the air flow passes. The cover 320 preferably includes at least a grid 330 through which the air flow passes and is directed. Preferably, the system 10 includes at least one light 40 disposed in the primary profile 11 adjacent the grid 330.

The present invention pertains to a method for providing air to a room. The method comprises the steps of placing a primary profile 11 in a ceiling 14 of the room. There is the step of connecting a ventilation duct 310 to a duct opening 300 of the primary profile 11. There is the step of flowing air from the ventilation duct 310 through the primary profile 11 into the room.

Figure 20:
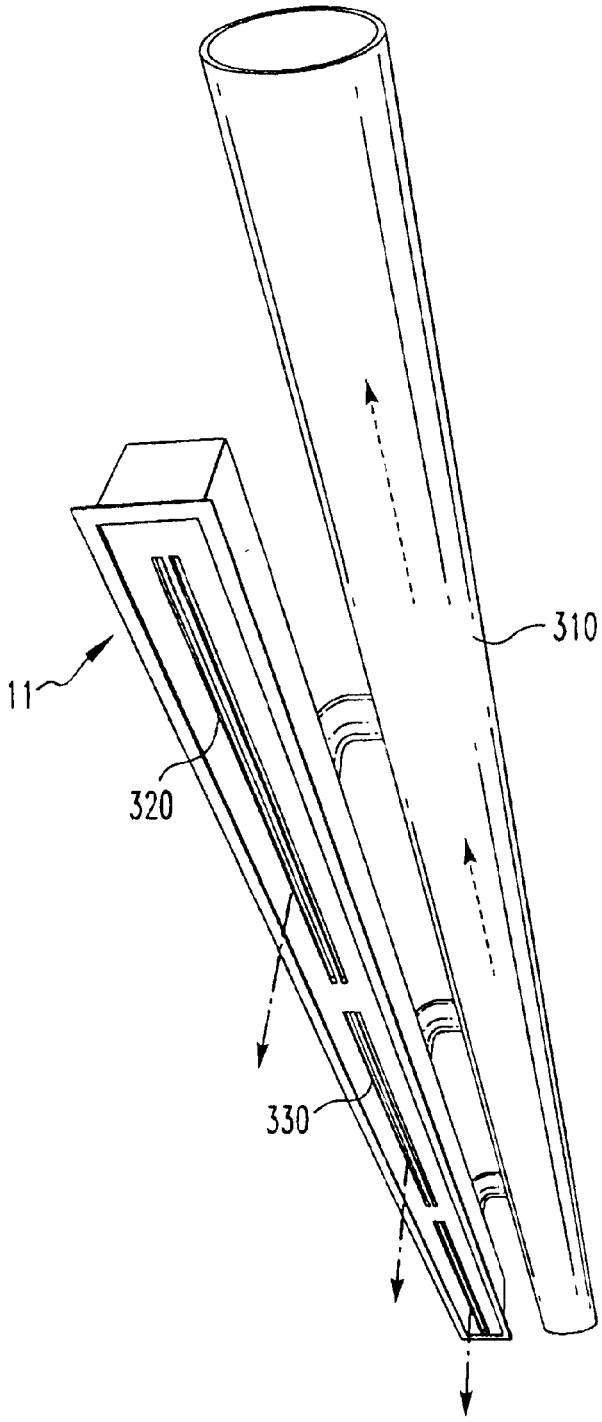
FIG. 20 is a perspective view of a primary profile having a cover with a longitudinal grid that is recessed into the primary profile.
Figure 21:
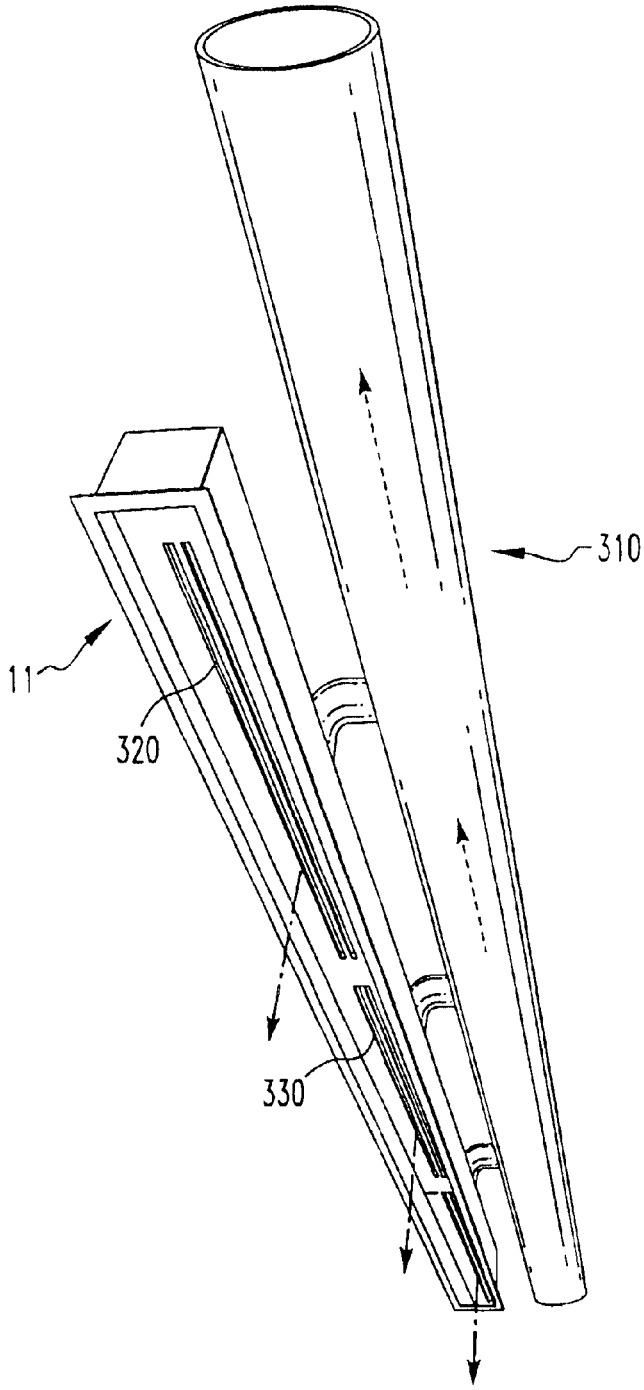
FIG. 21 is a perspective view of a primary profile with a cover having a longitudinal grid that is flush-mounted.
Figure 22:
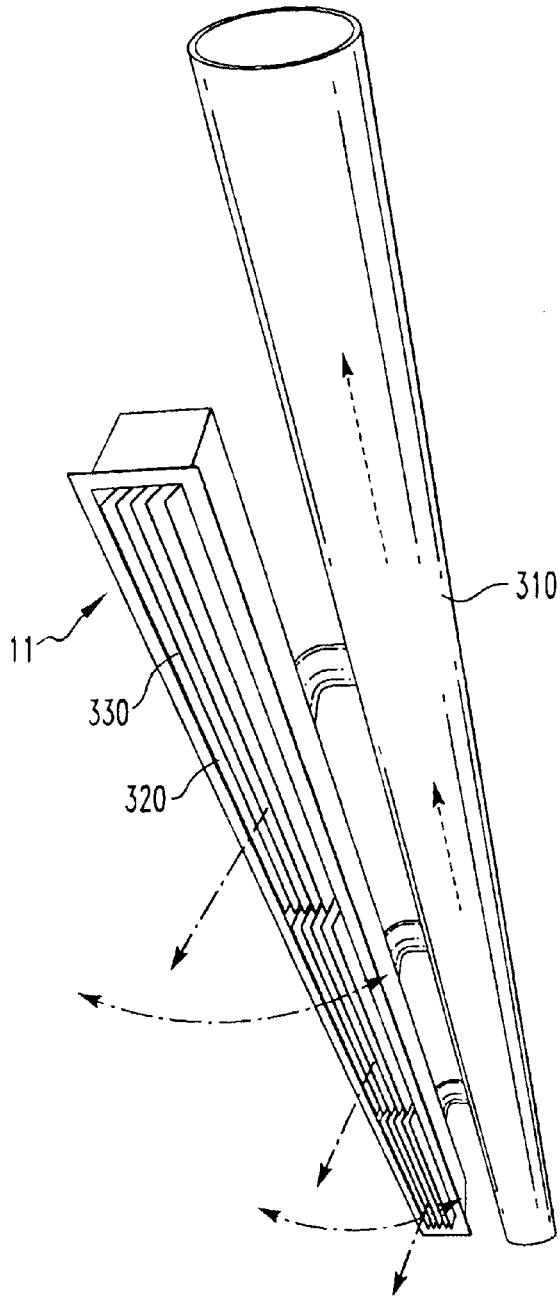
FIG. 22 is a schematic representation of a primary profile having motorized lamellas.
Figure 23:
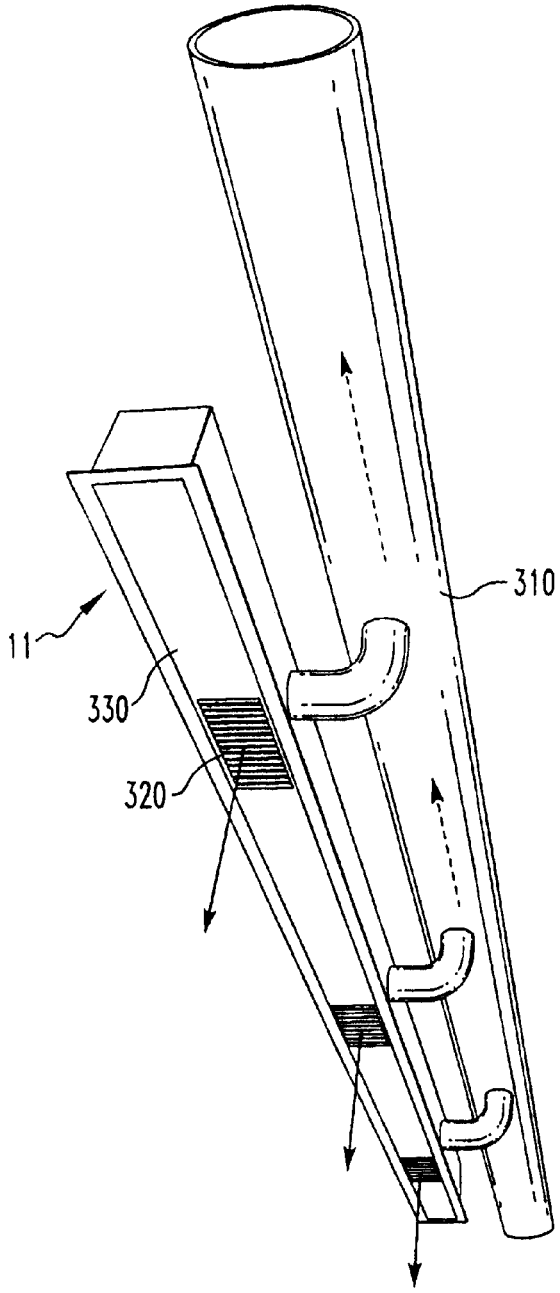
FIG. 23 is a perspective view of a primary profile having a cover with short transversal grids.
Figure 24:
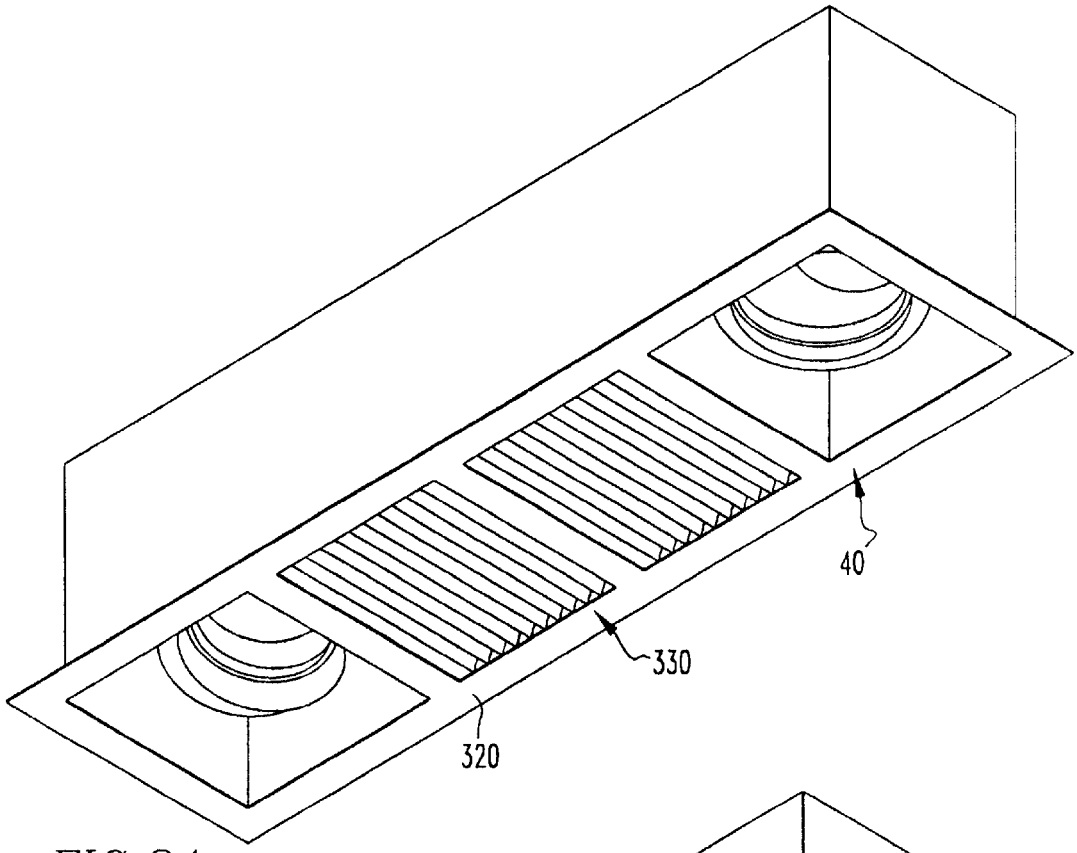
FIG. 24 is a perspective view and of a primary profile having a cover with short transversal grips and 2 lights.

In operation, when the primary profile 11 is placed in the ceiling 14, the duct opening 300 is aligned with a ventilation duct 310 already present in the building in which the room is located. A cover 320 can be disposed over the face of the primary profile 11. FIG. 20 shows an air channel that provides air from the top of the primary profile 11 combined with one longitudinal grid 330 in the cover 320 that is recessed into the primary profile 11. FIG. 21 shows a longitudinal grid 330 in a cover 320 that is flush-mounted in the primary profile 11. FIG. 22 shows moving (motorized) lamellas in the cover 320 to divide the air into the room. FIG. 23 shows a cover 320 with short transversal grids 330. FIG. 24 shows lights 40 disposed adjacent the grids 330 in the primary profile 11.

Figure 25:
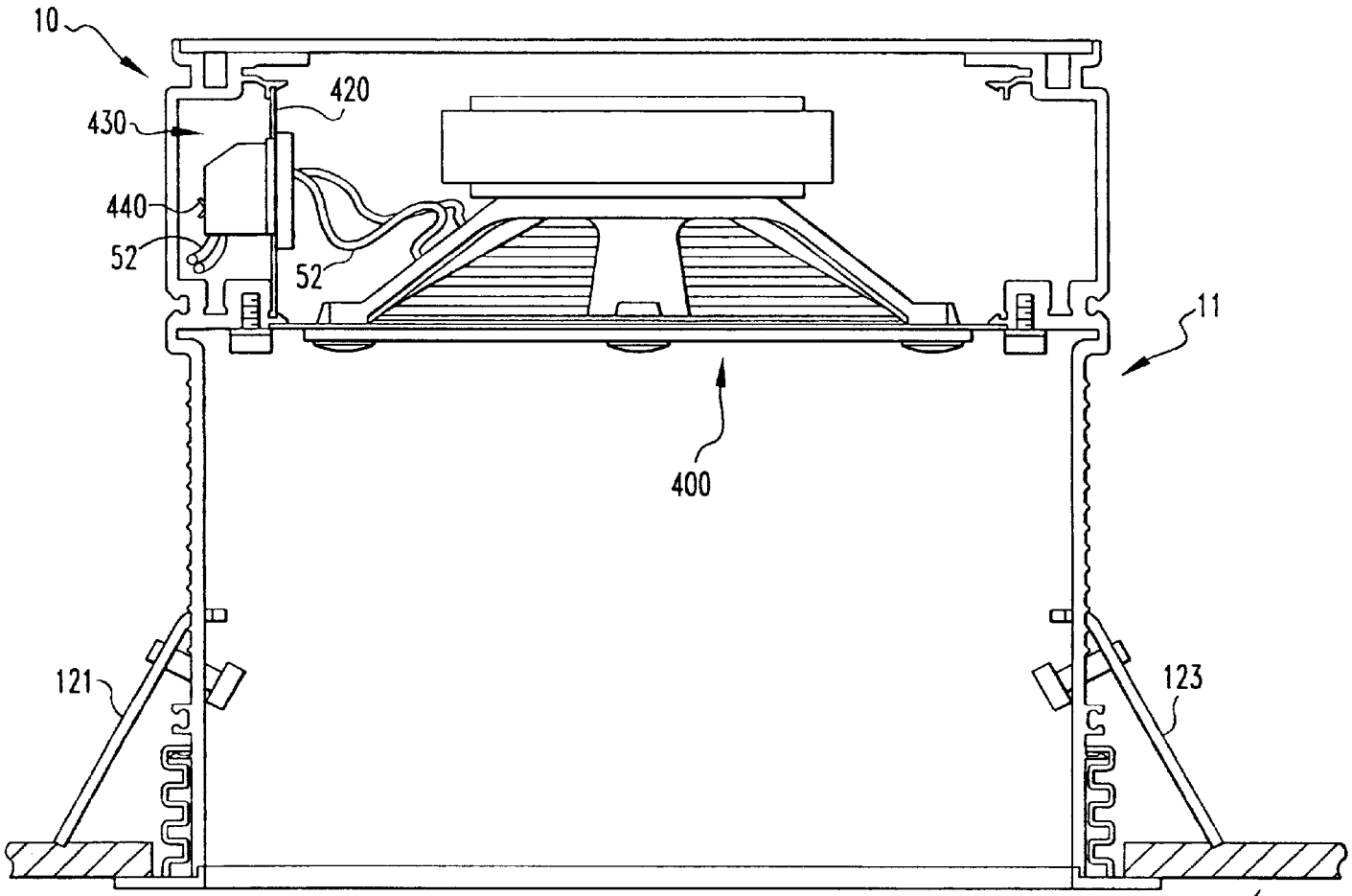
FIG. 25 is a cross-sectional view of a primary profile with a speaker.

The present invention pertains to a system 10 for placement in a ceiling 14 of a room to provide sound to the room, as shown in FIG. 25. The system 10 comprises a primary profile 11 for placement in the ceiling 14. The system 10 comprises a speaker 400 attached to the primary profile 11.

Preferably, the speaker 400 has wires 52 adapted to connect to a sound source 410. The primary profile 11 preferably includes a first side member 16, and a second side member 18 in spaced relation with the first side member 16. The first side and second side members define a length between them. The primary profile 11 preferably includes a connecting member 20 which attaches to the first side and second side members and connects the first side member 16 with the second side member 18. The speaker 400 is disposed between the first side member 16 and the second side member 18.

Preferably, the first side member 16 includes a first main profile 26 having a top 28 and bottom 30 and the second side member 18 includes a second main profile 32 having a top 28 and a bottom 30, and the connecting member 20 includes a top plate 34 which attaches to the top 28 of the first and second main profiles. Each main profile preferably includes an upper internally ribbed boss 36 in proximity to the top 28 of each main profile and the lower internally ribbed boss 38 in spaced relation with the upper internally ribbed boss 36, and the lower internally ribbed boss 38 on each main profile are together adapted to hold a middle plate 230 to which the speaker 400 is connected. Preferably, the system 10 includes a speaker side plate 420 connected to the upper internally ribbed boss 36 and lower internally ribbed boss 38 of the first main profile 26 to define a wiring channel 430, and the speaker 400 includes a speaker wiring terminal 440 connected to the speaker side plate 420 and disposed in the wiring channel 430. The system 10 preferably includes a light 40 connected to the primary profile 11 adjacent to the speaker 400.

The present invention pertains to a method for providing sound to a room. The method comprises the steps of placing a primary profile 11 in a ceiling 14 of the room. There is the step of attaching a speaker 400 to the primary profile 11. There is the step of connecting wires 52 between the speaker 400 and EL sound source 410.

In operation, after the primary profile 11 is in place in the ceiling 14, the speaker 400 is attached to middle plate 230 and the speaker wiring terminal 440 is attached to the speaker side plate 420. The speaker side plate 420 and the metal plate 230, with the speaker wiring terminal 440 and the speaker 400, respectively, are together moved to the back of the primary profile 11. The speaker side plate 420 is then connected to the first main profile 26, forming a wiring channel 430. The wires 52 from the speaker 400 extend through the speaker wiring terminal 440 where they effectively communicate through additional wires 52 in the wiring channel 430 to a sound source 410. When sound, such as music, is produced from the sound source 410, the speaker plays the music from the signals received through the wires 52, as is well-known in the art.

Figure 26:
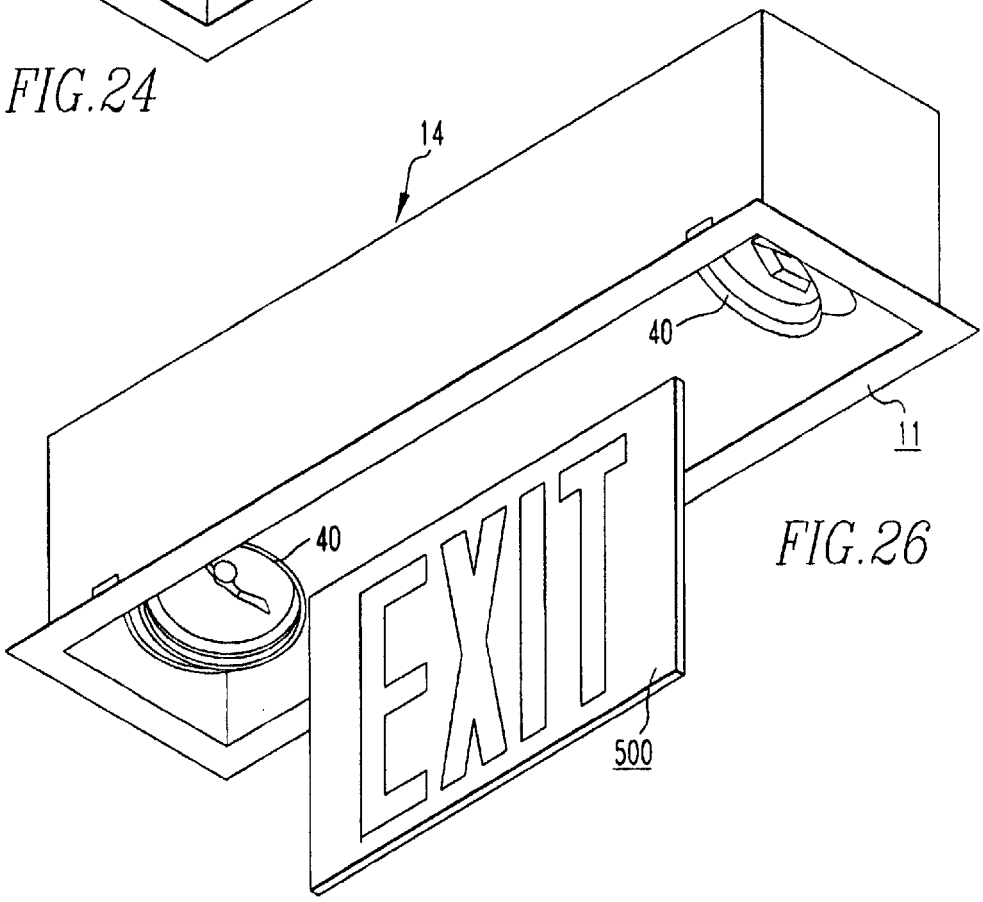
FIG. 26 is a perspective view of a primary profile having a sign and 2 lights.

The present invention pertains to a system 10 for placement in a ceiling 14 of a room to provide information to the room, as shown in FIG. 26. The system 10 comprises a primary profile 11 for placement in the ceiling 14. The system 10 comprises a sign 500 having the information extending from the primary profile 11.

Preferably, the first side member 16 includes a first main profile 26 having a top 28 and bottom 30 and the second side member 18 includes a second main profile 32 having a top 28 and a bottom 30, and the connecting member 20 includes a top plate 34 which attaches to the top 28 of the first and second main profiles. Each main profile preferably includes an upper internally ribbed boss 36 in proximity to the top 28 of each main profile and the lower internally ribbed boss 38 in spaced relation with the upper internally ribbed boss 36, and the lower internally ribbed boss 38 on each main profile are together adapted to hold a middle plate 230 to which the speaker 400 is connected. Preferably, the system 10 includes a speaker side plate 420 connected to the upper internally ribbed boss 36 and lower internally ribbed boss 38 of the first main profile 26 to define a wiring channel 430, and the speaker 400 includes a speaker wiring terminal 440 connected to the speaker side plate 420 and disposed in the wiring channel 430. The system 10 preferably includes a light 40 connected to the primary profile 11 adjacent to the speaker 400.

Preferably, the primary profile 11 includes a first side member 16; a second side member 18 in spaced relation with the first side member 16, the first side and second side members defining a length between them; and a connecting member 20 which attaches to the first side and second side members and connects the first side member 16 with the second side member 18. Each main profile preferably includes an upper internally ribbed boss 36 in proximity to the top 28 of each main profile and the lower internally ribbed boss 38 in spaced relation with the upper internally ribbed boss 36, and the lower internally ribbed boss 38 on each main profile are together adapted to hold a middle plate 230 which connects to the sign 500. Preferably, the system 10 includes a light 40 connected to the primary profile 11 adjacent to the sign 500.

The present invention pertains to a method for providing information to a room. The method comprises the steps of placing a primary profile 11 in a ceiling 14 of the room. There is the step of attaching a sign 500 to the primary profile 11.

In operation, after the primary profile 11 is in place in the ceiling 11, a sign, which is attached to the middle plate 230, is then moved into the primary profile 11. The middle plate 230 is then positioned in place and secured in the primary profile 11.

In all of these embodiments, if it is so desired, a light, or a plurality of lights can be positioned in the profile adjacent to the respective elements identified above. In this way, for instance, lighting can be used to accent a sign, or be used in conjunction with a sprinkler or grids in a cover, or with speakers, so the presence of the primary profile 11 can serve more than a single purpose of, for instance, holding a sprinkler, or holding only a light, or only providing air flow to a room. This is in addition to the ease by which the placement of a primary profile 11 facilitates the introduction of a light, or lights, or sprinklers, or speakers, etc. into a ceiling or wall of a room.

Figure 27:
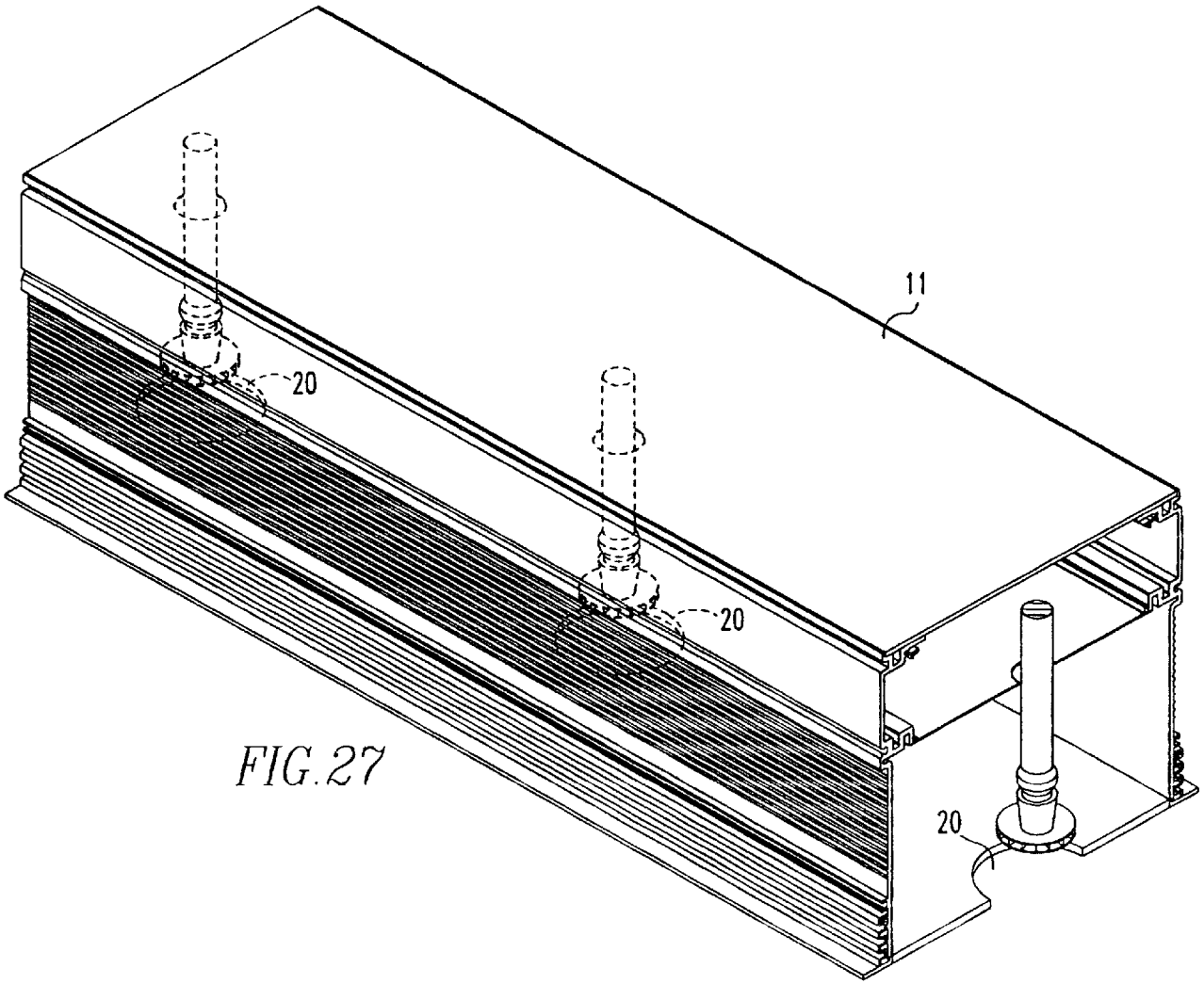
FIG. 27 is a schematic representation of a one-piece panel with a primary profile.

In another embodiment, as shown in FIG. 27, a one-piece panel is placed across the primary profile to obscure the primary profile from sight. The one-piece panel has holes in it to allow light from the lamps in the primary profile to escape and shine into the room. The one-piece panel can be made out of gypboard, wood, or metal with the holes cut out of the material to form the one-piece panel, or the one-piece panel can be molded of plaster or plastic, with the holes defined by lands in the mold in which the one-piece panel is formed. The one-piece panel has at least two holes, and can have as many as 20 holes, disposed in the primary profile, depending on how long the primary profile is. Alternatively, there can be several one-piece panels aligned together to cover the primary profile. Tape can be used to cover any lines that define interfaces between the one-piece panel and the wall or ceiling surface in which it is disposed with spackle placed on the tape to make it invisible. The one-piece panel can be attached to the primary panel after the primary panel is in place in the ceiling, or the one-piece panel can be attached to the primary profile before the primary profile is attached to the ceiling. The one-piece panel can be screwed or riveted are nailed to the primary profile. See U.S. patent application Ser. No. 10/005,255, incorporated by reference herein.

Figure 28:
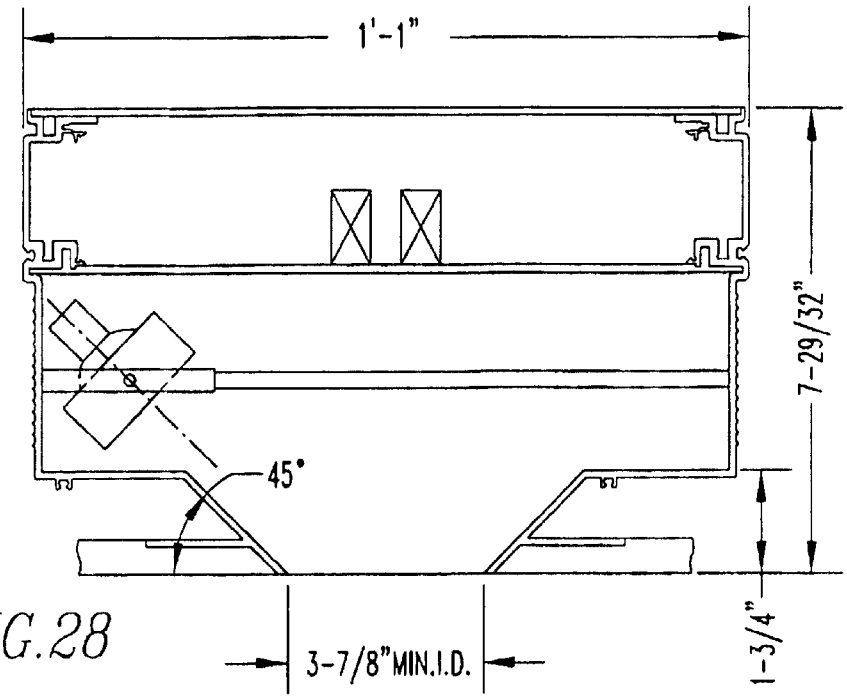
FIG. 28 is a schematic representation of a symmetric trimless primary profile.
Figure 29:
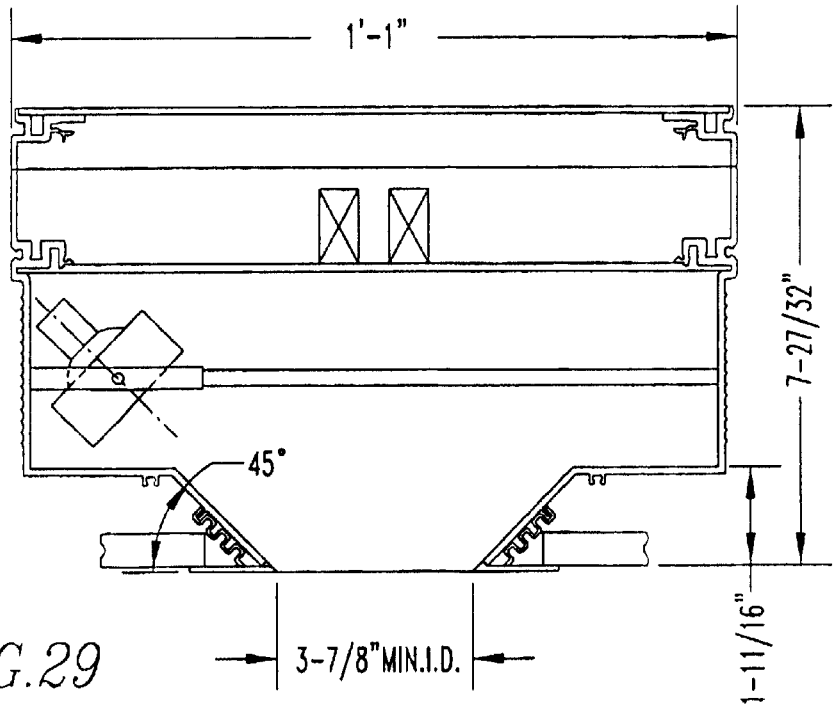
FIG. 29 is a schematic representation of a symmetric trimmed primary profile.

FIG. 28 shows a symmetric trimless primary profile where the lamps are disposed in the primary profile in such a way that they are of essentially obscured from view to an observer in the room by being position behind the front surface of the primary profile. FIG. 29 shows a similar symmetric primary profile which is trimmed.

Figure 30:
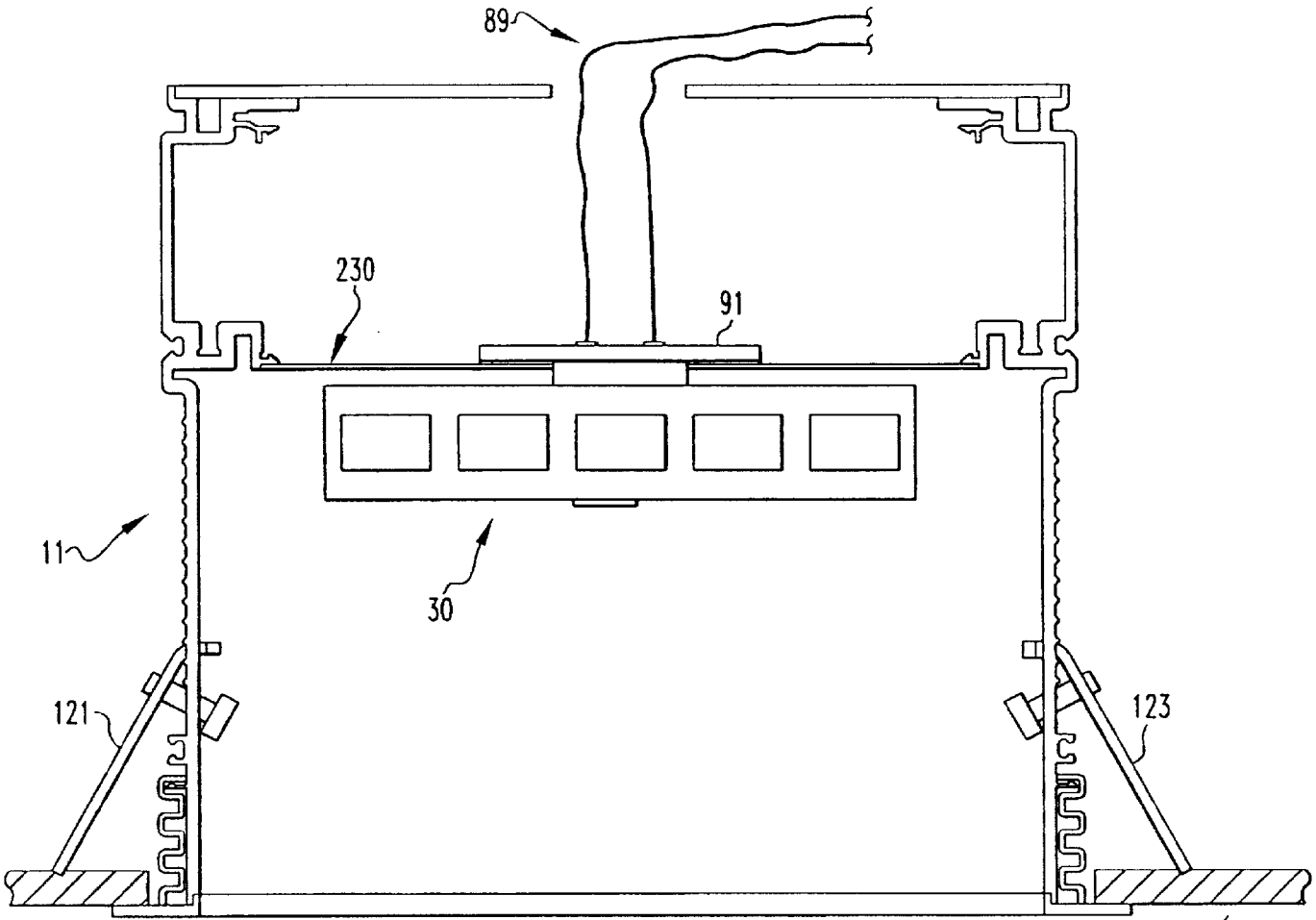
FIG. 30 is a schematic representation of a smoke detector with a primary profile.

FIG. 30 shows a primary profile 11 in which is disposed a smoke detector 87. Wiring 89 runs behind the ceiling and connects to the smoke detector 87 to provide power to the smoke detector 87 and a communications conduit through which alarm information can be transmitted to an outside monitoring station. The smoke detector 87 can be a standard type of smoke detector 87 that detects smoke, $CO_2$, heat or other types of fluids. The smoke detector 87 can be mounted into the primary profile 11 through a bracket 91.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A system for placement in a ceiling of a room to provide a fluid to the room comprising:

a primary profile for placement in the ceiling, the primary profile includes a first side member; a second side member in spaced relation with the first side member, the first side and second side members defining a length between them; a first and second terminal plate connected to opposing ends of the first and second side members and a connecting member which attaches to the first side and second side members and connects the first side member with the second side member, the terminal plates, connecting member and first and second side members defining an enclosure;

a sprinkler extending into the enclosure of the primary profile between the first side member and the second side member through the connecting member and adapted to connect to a pipe carrying the fluid so the sprinkler will spray fluid in the room when the sprinkler is activated.

2. A system as described in claim 1 wherein the sprinkler includes a juncture which is adapted to connect with the water pipe wherein water from the water pipe can flow into the sprinkler.

3. A system as described in claim 2 the first side member includes a first main profile having a top and bottom and the second side member includes a second main profile having a top and a bottom, and the connecting member includes a top plate which attaches to the top of the first and second main profiles.

4. A system as described in claim 3 wherein each main profile includes an upper internally ribbed boss in proximity to the top of the main profile and the lower internally ribbed boss in spaced relation with the upper internally ribbed boss, and the lower internally ribbed boss on each main profile are together adapted to hold a metal plate through which the sprinkler extends.

5. A system as described in claim 4 including a first clamp and a second clamp which holds the first side member and second side member, respectively, in place in the ceiling, the first lamp and the second clamp disposed against the ceiling and the first side member and the second side member, respectively.

6. A system as described in claim 5 wherein the lower and upper internally ribbed boss on each main profile together are adapted to hold a vertical plate to define a wiring channel.

7. A system as described in claim 6 including a trim profile and a trimless profile, each side member attaching to either a trim profile or a trimless profile to form a symmetrical or asymmetrical cross-section.

8. A method for protecting a room from fire comprising the steps of:

placing a primary profile having an enclosure defined by a first side member and a second side member opposing the first side member, a first terminal plate and a second terminal plate opposing the first terminal plate, the first and second terminal plates connected to opposing ends of the first and second side members, and a connecting member connected to the first and second side members and terminal plates in the ceiling;

extending a sprinkler through the enclosure of the primary profile; and connecting the sprinkler to a pipe carrying fluid so the sprinkler will spray the fluid in the room when the sprinkler is activated.

* * * * *